US005611542A

United States Patent [19]

Saunders

[11] Patent Number: 5,611,542

[45] Date of Patent: Mar. 18, 1997

[54] OUTSERT FOR ARROWS

[76] Inventor: Thomas A. Saunders, 1424 Vinton St., Omaha, Nebr. 68108

[21] Appl. No.: 703,443

[22] Filed: Aug. 27, 1996

[51] Int. Cl.[6] ..... F42B 6/04

[52] U.S. Cl. ..... 473/578

[58] Field of Search ..... 273/416, 419, 273/423

[56] References Cited

U.S. PATENT DOCUMENTS

| | | | |
|---|---|---|---|
| 2,265,564 | 12/1941 | Klopsteg | 273/419 |
| 2,289,284 | 7/1942 | Chandler | 273/421 X |
| 2,816,765 | 12/1957 | Stockfleth | 273/421 |
| 4,570,941 | 2/1986 | Saunders | 273/422 |
| 4,874,180 | 10/1989 | Fingerson et al. | 273/416 |
| 4,943,067 | 7/1990 | Saunders | 273/416 |
| 4,944,520 | 7/1990 | Fingerson et al. | 273/419 |
| 5,114,156 | 5/1992 | Saunders | 273/419 |
| 5,145,186 | 9/1992 | Maleski | 273/422 |
| 5,269,534 | 12/1993 | Saunders et al. | 273/419 |
| 5,287,842 | 2/1994 | Saunders | 124/91 |
| 5,354,068 | 10/1994 | Maleski | 273/422 |
| 5,417,439 | 5/1995 | Bickel | 273/416 |

*Primary Examiner*—Paul E. Shapiro

*Attorney, Agent, or Firm*—Zarley, McKee, Thomte, Voorhees & Sease; Mark D. Frederiksen

[57] ABSTRACT

An outsert includes an elongated tubular member having forward, central and rearward sections, for connecting an arrow shaft to an attachment for the arrow. The outsert rearward section has a cylindrical rearward bore with a diameter greater than the outer diameter of the arrow shaft for receiving the forward end of the arrow shaft therein. The outsert rearward section also includes a tapered bore extending forwardly from the rearward bore, the tapered bore having a decreasing diameter such that the forward end of the arrow shaft contacts the tapered bore between the forward and rearward ends of the tapered bore. The outer surface of the rearward section of the outsert is tapered and receives a ferrule for crimping the rearward section of the outward into contact with the arrow shaft to assure coaxial alignment of the outsert with the arrow shaft.

24 Claims, 3 Drawing Sheets

OUTSERT FOR ARROWS

TECHNICAL FIELD

The present invention relates generally to an outsert for the ends of an arrow shaft, and more particularly to an outsert which assures that a longitudinal axis of the outsert will always be in alignment with the longitudinal axis of the arrow shaft.

BACKGROUND OF THE INVENTION

Arrows that are used in the sport of archery may be formed of a wide variety of materials, including wood, aluminum or other metals, and carbon fiber materials. The aluminum and carbon fiber arrows are usually formed in a hollow tubular configuration, with a nock attached to the rearward end of the shaft and various types of points attached to the forward end of the shaft.

In the construction of a complete arrow, a shaft is first cut to the desired length and then an attachment structure may be mounted on the forward and rearward ends to connect the desired point and nock into position on the ends of the shaft. Although the point and nock may be permanently mounted to the shaft, it has become common to provide an attachment structure for the shaft which permits replacement of the point with a variety of structures, including broadheads, target points and the like.

Currently, metal inserts are provided for attaching a point or nock to the ends of an arrow shaft. Commonly, the insert is glued into the interior of the shaft, and is provided with an interiorly threaded bore for connection of a point or nock. One critical problem in the attachment of inserts on hollow shafts is in the mounting of the insert in coaxial alignment with the shaft. Because of spaces provided for glue between the metal insert and shaft, there is a loose fit between the insert and shaft, which permits the possibility of misalignment of the insert with the shaft during the curing of the glue which holds the insert in position.

One solution to this problem is provided in U.S. Pat. No. 4,943,067 to Thomas A. Saunders, which calls for an arrow insert having a pair of annular alignment rings with outer diameter slightly larger than the inside diameter of the arrow shaft. In this way, as the insert is pushed into the arrow shaft, the alignment rings will assure substantial coaxial alignment of the insert with the shaft because of direct continuous contact of the annular rings with the interior of the shaft.

While the arrow insert of the '067 patent works well for hollow metal shafts, newer shafts are being formed in increasingly smaller diameters and with increasingly lighter weight materials, including carbon fiber and the like. These new materials are typically weaker in radial tensile strength than prior art heavier weight materials, and therefore can easily crack if an insert applies too great of an outward pressure by virtue of alignment rings on the insert. In addition, as the shaft diameter decreases, it is more difficult to provide a central threaded bore which will receive the common arrow point threaded shaft, for easy replacement of points.

SUMMARY OF THE INVENTION

It is therefore a general object of the present invention to provide an outsert for an arrow shaft which assures alignment of the longitudinal axis of the outsert with the longitudinal axis of the arrow shaft.

Yet another object is to provide an outsert for an arrow shaft which does not place an outwardly directed radial force on the arrow shaft.

A further object of the present invention is to provide an outsert for an arrow shaft having a central threaded bore for receiving a nock or an arrow point.

These and other objects will be apparent to those skilled in the art.

The outsert of the present invention includes an elongated tubular member having forward, central and rearward sections, for connecting an arrow shaft to an attachment for the arrow. The outsert rearward section has a cylindrical rearward bore with a diameter greater than the outer diameter of the arrow shaft for receiving the forward end of the arrow shaft therein. The outsert rearward section also includes a tapered bore extending forwardly from the rearward bore, the tapered bore having a decreasing diameter such that the forward end of the arrow shaft contacts the tapered bore between the forward and rearward ends of the tapered bore. A central portion of the outsert has a concave annular outer surface which serves a number of purposes. First, it reduces the overall weight of the outsert. Second, it reduces drag as the arrow passes through the air. Finally, it reduces mat wear on the target. The outer surface of the rearward section of the outsert is tapered and receives a ferrule for crimping the rearward section of the outward into contact with the arrow shaft to assure coaxial alignment of the outsert with the arrow shaft.

DESCRIPTION OF THE PREFERRED EMBODIMENT

Figure 1:
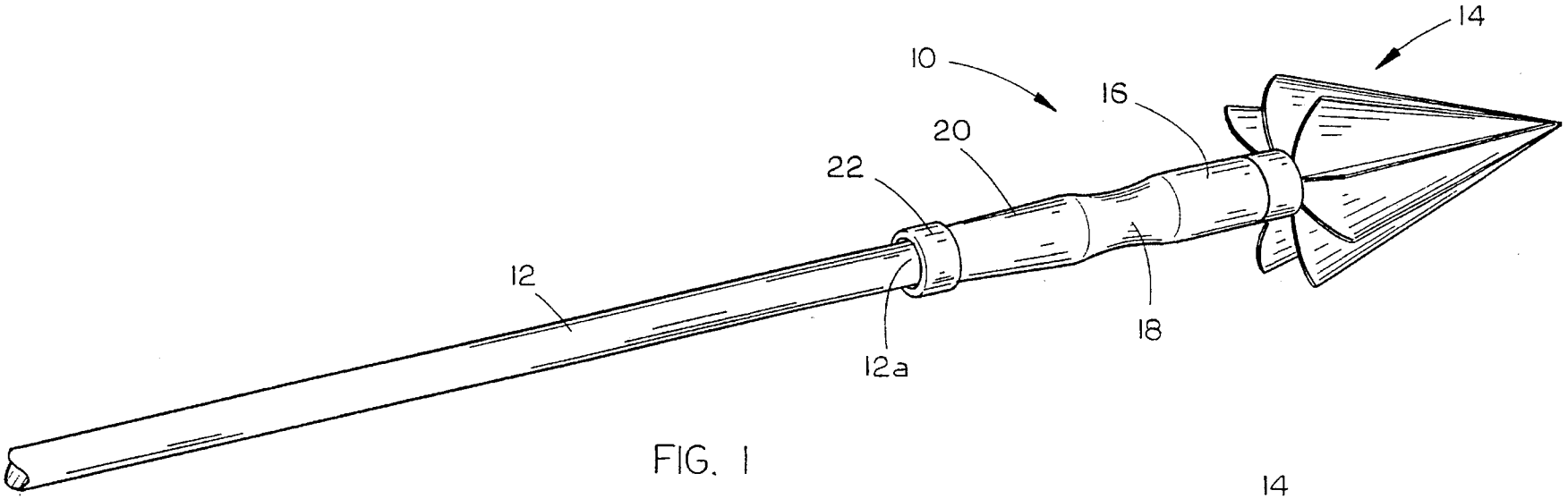
FIG. 1 is a perspective view of a forward end of an arrow shaft with the outsert of the present invention attached thereto.

Referring now to the drawings, wherein similar or corresponding parts are identified with the same reference numeral and more particularly to FIG. 1, the outsert of the present invention is designated generally at 10 and is shown interconnecting a forward end 12*a* of an arrow shaft 12 to a point 14. It should be understood that outsert 10 may also be attached to the rearward end of arrow shaft 12 for attachment of a nock, although not shown in the drawings.

Outsert 10 is a generally cylindrical metal body having a forward portion 16, a central section 18 and a rearward section 20. As discussed in more detail hereinbelow, a ferrule 22 is slipped over shaft 12 and thence over rearward section 20 to align outsert 10 for securement in coaxial alignment with shaft 12.

Figure 2:
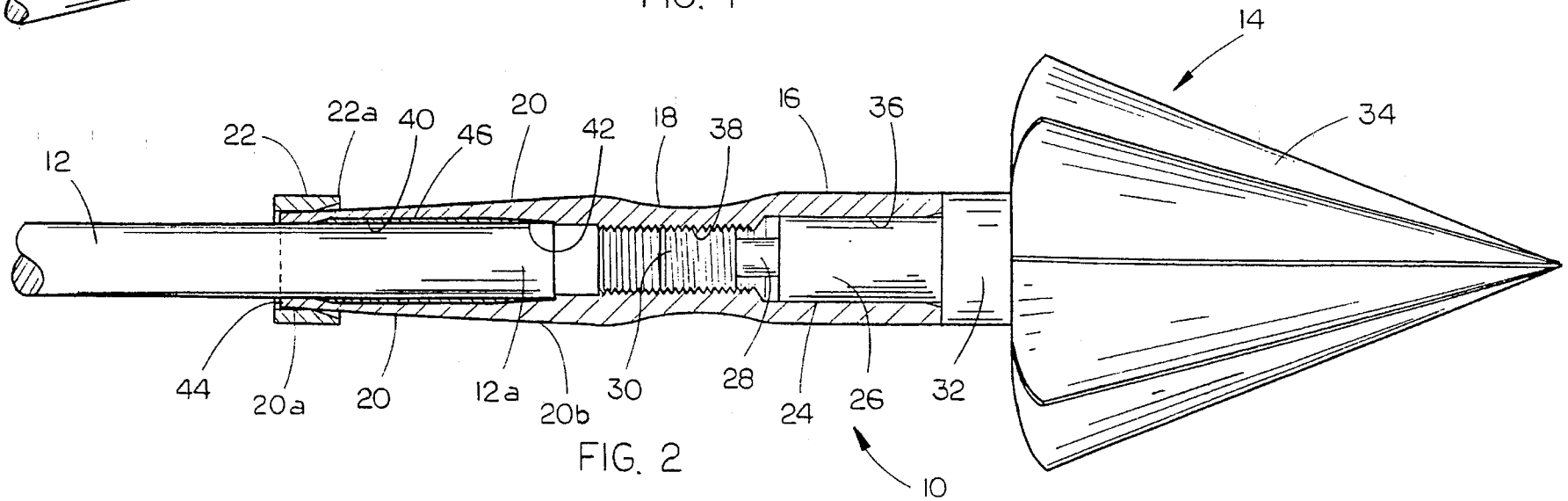
FIG. 2 is a longitudinal cross-sectional view through the outsert of the present invention.
Figure 3:
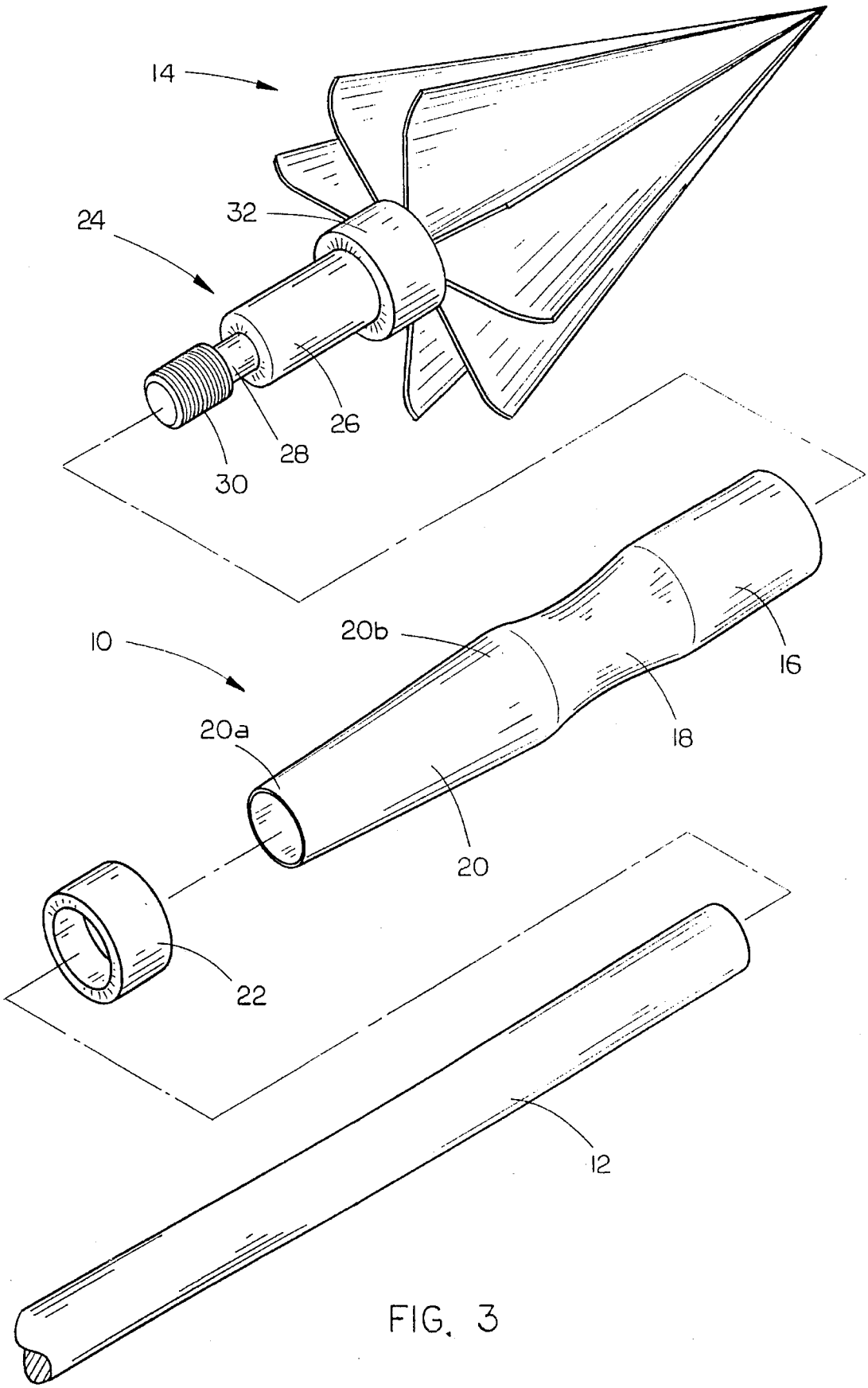
FIG. 3 is an enlarged exploded perspective view of the invention with an associated arrow point and arrow shaft.

Referring now to FIGS. 2 and 3, the conventional arrow point 14 includes a stepped shank 24 including a forward generally cylindrical section 26 from which a stud 28 of a smaller diameter extends rearwardly coaxially therewith. A threaded end 30 is formed on the rearward end of stud 28 to engage a threaded bore on the conventional attachment on an arrow shaft. A cylindrical base 32 is formed between the point 34 and shank 24 to provide a shoulder against which the forward section 16 of outsert 10 will contact to seat the arrow point 14 on arrow shaft 12.

Figure 4:
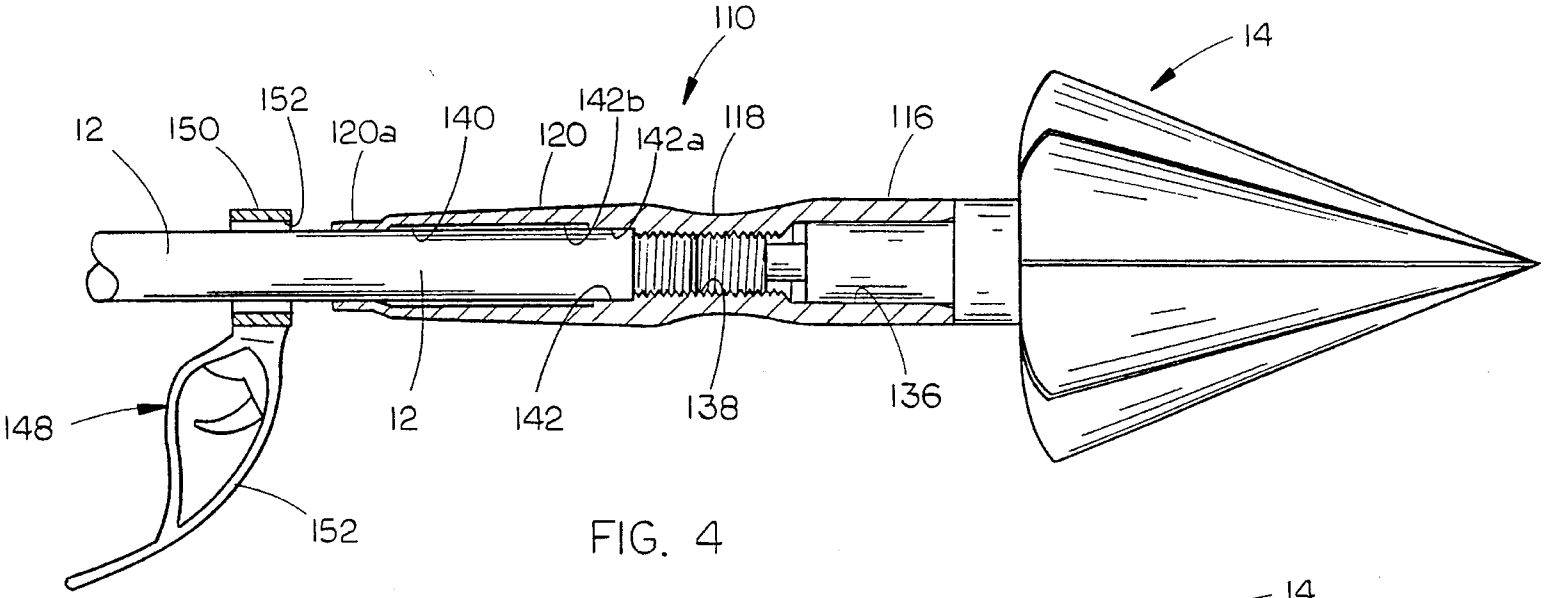
FIG. 4 is a longitudinal cross-sectional view through a second embodiment of the outsert of the present invention.

Referring now more specifically to FIG. 2, outsert 10 includes a forward bore 36 which is cylindrical in shape and has a diameter slightly greater than the diameter of arrow point forward section 26, for a slidable fit therein. Central section 18 is provided with an interiorly threaded bore 38 having a smaller diameter than forward bore 36, and adapted to engage threaded end 30 of arrow point 14. Rearward section 20 of outsert 10 includes a cylindrical rearward bore 40 extending forwardly from the rearward end of outsert 10, and a tapered bore 42, extending from a forward end of rearward bore 40 to a rearward end of threaded bore 38. "Tapered bore" 42 decreases in diameter from a rearward end at its juncture with rearward bore 40 to a forward end at its juncture with threaded bore 38. As shown in the drawings, tapered bore 42 has a diameter greater than the diameter of arrow shaft 12 to permit space for receiving glue therebetween, and reduces to a diameter less than the diameter of shaft 12, such that the forward end 12*a* of shaft 12 will come into contact with tapered bore 42 intermediate the forward and rearward ends of tapered bore 42, thereby aligning the forward end 12*a* of arrow shaft 12 in coaxial alignment with the longitudinal axis of outsert 10. Although tapered bore 42 is shown with a continuously decreasing diameter tapered interior surface, it should be understood that the term "tapered bore" is intended to include equivalent structure, such as a stepped cylindrical surface with a forward "step" of a diameter producing a light interference fit with shaft forward end 12*a*, as shown in FIG. 4.

Referring once again to FIG. 3, forward section 16 of outsert 10 preferably has a cylindrical exterior surface with a diameter substantially equal to the diameter of arrow point base 32. Central section 18 has a concave annular surface extending between forward section 16 and rearward section 20, permitting the archer to more easily grip the outsert when attaching or removing arrow point 14. In addition, the concave annular surface of central section 18 reduces the weight of the unit, and is believed to reduce drag as the arrow passes through the air. Rearward section 20 has a tapered outer surface which decreases in diameter from a forward end joining central section 18, to its rearward end. As shown in both FIGS. 2 and 3, this produces an extremely thin wall at the rearward end 20*a* of rearward section of outsert 10.

Ferrule 22 has a cylindrical outer surface, and is utilized to firmly position the rearward end 20*a* of outsert 10 in coaxial alignment with the longitudinal axis of arrow shaft 12.

Referring again to FIG. 2, it can be seen that the interior surface 44 of ferrule 22 has a diameter which is greater than the outer diameter of the extreme rearward end 20*a* of outsert rearward section 20, but less than the outer diameter of the forward end 20*b* of rearward section 20 of outsert 10. Thus, forward slidable movement of ferrule 22 along outsert rearward section 20 will cause the interior surface 44 of ferrule 22 to contact the outer surface of outsert rearward section 20 and compress it radially inwardly into contact with arrow shaft 12. This "crimping" of the rearward end 20*a* of outsert rearward section 20 provides a second point of alignment of outsert 10 on arrow shaft 12, spaced rearwardly of the forward contact of arrow shaft forward end 12*a* with the tapered bore 42. These forward and rearward circumferential contacts assure longitudinal coaxial alignment of outsert 10 with the longitudinal axis of shaft 12, while providing space for glue 46 between shaft 12 and outsert 10.

In the preferred embodiment of the invention, interior surface 44 of ferrule 22 is beveled outwardly at the forward end 22*a* of ferrule 22, to more easily direct the rearward end 20*a* of outsert rearward section 20 into ferrule 22.

A second embodiment of the invention is designated generally at 110 in FIG. 4 and is shown interconnecting the forward end of an arrow shaft 12 to a point 14. Outsert 110 is identical to outsert 10, except for the formation of the "tapered bore" 142. Tapered bore 142 includes at least one cylindrical "step" 142*a* which has a diameter less than a second rearward step 142*b* of tapered portion 142. As shown in FIG. 4, the rearward step 142*b* of tapered bore 142 has the same diameter as cylindrical rearward bore 140. The forward step 142*a* of tapered bore 142 has a diameter which forms a light interference fit with the forward end of arrow shaft 12.

As with the first embodiment of the invention, outsert 110 includes a generally cylindrical metal body having a forward portion 116, central section 118 and rearward section 120, forward section 116 having a forward bore 136 while central section 18 has an interiorly threaded bore 138.

As shown in FIG. 4, the rearward end 120*a* of outsert rearward section 120 is crimped into an interference fit with arrow shaft 12. While this crimping action is affected by a ferrule 22 in the first embodiment of the invention, a crimping tool or swedge 148 is utilized to crimp rearward end 120*a* of outsert 110 in the second embodiment of the invention. The use of a swedge 148 eliminates the weight of a ferrule, yet creates the interference fit of the outsert on the arrow shaft at both the forward and rearward ends of the rearward section 120 of outsert 110.

As shown in FIG. 4, swedge 148 may be of any conventional configuration, but preferably has a two piece ring portion 150 which may be assembled over shaft 12. A handle 152 on ring portion 150 is utilized to slide ring portion 150 forwardly such that the interior surface 152 of ring portion 150 slides over rearward end 120*a* of outsert 110 and crimps the outsert against shaft 12.

Figure 5:
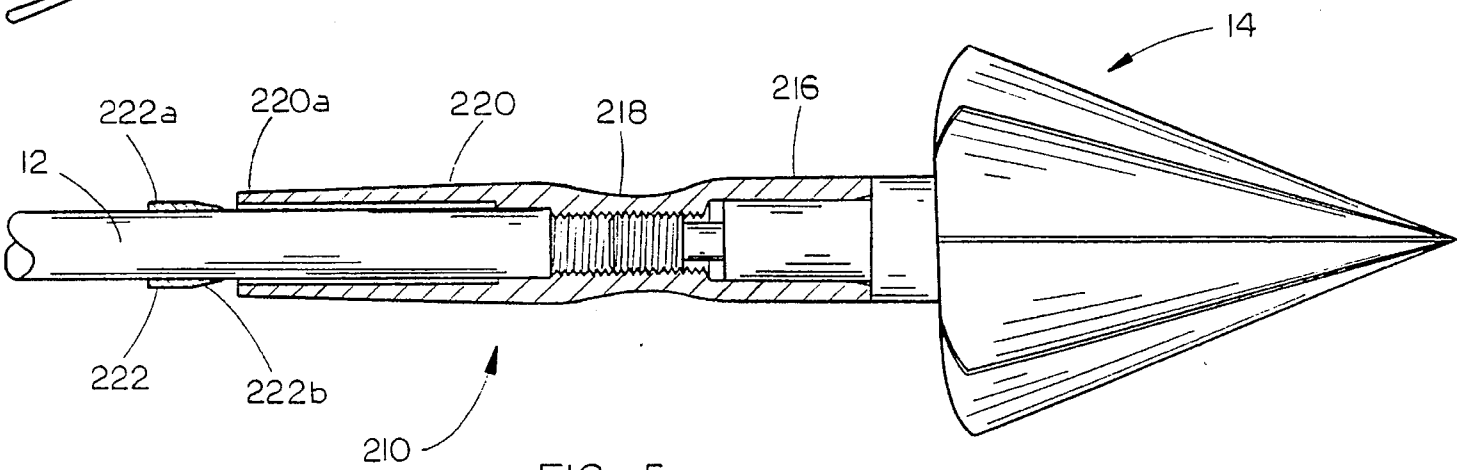
FIG. 5 is a longitudinal cross-sectional view through a third embodiment of the outsert of the present invention.

Referring now to FIG. 5, a third embodiment of the outsert is designated generally at 210 and includes the same cylindrical body having a forward section 216, central section 218 and rearward section 220, as the first embodiment of the invention. In this third embodiment of this outsert 210, an inner ferrule 222 is utilized to form the interference fit between the rearward end 220*a* of outsert rearward section 220 and arrow shaft 12. Ferrule 222 is formed of a deformable metal material and is slidably mounted on arrow shaft 12. Ferrule 222 has a rearward outer diameter 222*a* which is greater than the inner diameter of the rearward end 220*a* of outsert 210. The outer diameter of the forward or leading edge 222*b* of ferrule 222 is less than the inner diameter of outsert rearward end 220*a*. In this way, as ferrule 222 is slid forwardly along shaft 12, the leading edge 222*b* will slide between outsert rearward end 220*a* and arrow shaft 12. As ferrule 222 continues forwardly, the rigid material of outsert 210 will crimp ferrule 222 into an interference fit with shaft 12, as the outer diameter of ferrule 222 increases.

Whereas the invention has been shown and described in connection with the preferred embodiment thereof, many modifications, substitutions and additions may be made which are within the intended broad scope of the appended claims.

I claim:

1. An outsert for an arrow shaft, comprising:

an elongated tubular member having a forward section, central section and rearward section;

means on said forward and central sections for connecting the outsert to an arrow attachment;

said rearward section having a cylindrical rearward bore therein extending forwardly from a rearward end of the outsert and having a longitudinal axis coaxial with a longitudinal axis of the outsert;

said rearward section including a tapered bore extending forwardly from a forward end of the rearward bore and having a longitudinal axis coaxial with the outsert longitudinal axis, said tapered bore having a first diameter at a forward end which is less than a second diameter rearwardly of the forward end; and said rearward section having a tapered outer surface decreasing in diameter from a forward end at the juncture of the rearward and central sections to the rearward end of the outsert.

2. The outsert of claim 1, further comprising a ring-shaped ferrule having an inner surface with at least a portion thereof having a diameter greater than the outer diameter of the rearward end of the outsert rearward section, but less than the outer diameter of the forward end of the outsert rearward section, wherein said ferrule will crimp a rearward portion of the outsert rearward end when moved forwardly onto the outsert.

3. The outsert of claim 2, wherein said ferrule inner surface includes a generally cylindrical portion extending forwardly from a rearward end of the ferrule.

4. The outsert of claim 3, wherein the ferrule inner surface includes a tapered portion increasing in diameter from a forward end of the ferrule cylindrical inner surface to a forward end of the ferrule.

5. The outsert of claim 4, wherein the tapered bore includes a continuously decreasing diameter, forming a smoothly tapered surface.

6. The outsert of claim 5, wherein the forward bore is cylindrical and has a diameter greater than that of the threaded bore.

7. The outsert of claim 6, wherein the central section has a concave annular outer surface.

8. The outsert of claim 1, wherein the tapered bore includes a continuously decreasing diameter, forming a smoothly tapered surface.

9. The outsert of claim 1, wherein the tapered bore includes a plurality of cylindrical steps with a first forward most step having a lesser diameter than a rearwardly adjacent cylindrical step.

10. The outsert of claim 1, wherein said means for connecting the outsert to an attachment includes a forward bore in the forward section extending rearwardly from the outsert forward end, and a threaded bore extending between the forward bore and the tapered bore.

11. The outsert of claim 1, further comprising a ring-shaped inner ferrule having an outer surface with a rearward portion thereof having a diameter greater than the inner diameter of the rearward end of the outsert rearward section, with a forward portion of the outer surface having a diameter less than the inner diameter of the outsert rearward section rearward end and located in the crimped portion with an inner ferrule inner surface having an interference fit with the arrow shaft.

12. In combination:

an arrow shaft having a generally cylindrical outer surface, forward and rearward ends, and a longitudinal axis;

an attachment for the forward end of the shaft;

an outsert for connecting the attachment in coaxial alignment with the longitudinal axis of the shaft, said outsert including:

an elongated tubular member having a forward section, central section and rearward section;

said rearward section having a cylindrical rearward bore therein extending forwardly from a rearward end of the outsert and having a diameter greater than the outer diameter of the shaft forward end;

said rearward section having a tapered bore extending forwardly from a forward end of the rearward bore, said tapered bore decreasing in diameter from a rearward end to a forward end, the diameter of the tapered bore rearward end being greater than the shaft outer diameter, and the tapered bore forward end having a diameter for an interference fit with the shaft forward end at a first annular surface of contact;

said rearward section having a tapered outer surface decreasing in diameter from a forward end to the outsert rearward end; and said rearward section having a crimped portion with an inner surface having a diameter for an interference fit with the arrow shaft outer surface to form a second annular surface of contact spaced rearwardly of the first annular surface of contact.

13. The combination of claim 12, further comprising a ring-shaped ferrule having an inner surface with at least a portion thereof having a diameter greater than the outer diameter of the rearward end of the outsert rearward section, but less than the outer diameter of the forward end of the outsert rearward section, said ferrule located to form the crimped portion of said rearward section.

14. The combination of claim 13, wherein said ferrule inner surface includes a generally cylindrical portion extending forwardly from a rearward end of the ferrule.

15. The combination of claim 14, wherein the ferrule inner surface includes a tapered portion increasing in diameter from a forward end of the ferrule cylindrical inner surface to a forward end of the ferrule.

16. The combination of claim 15, wherein the tapered bore includes a continuously decreasing diameter, forming a smoothly tapered surface.

17. The combination of claim 16, wherein the central section has a concave annular outer surface.

18. The outsert of claim 15, wherein the tapered bore includes a plurality of cylindrical steps with a first forward most step having a lesser diameter than a rearwardly adjacent cylindrical step.

19. The combination of claim 12, wherein the tapered bore includes a continuously decreasing diameter, forming a smoothly tapered surface.

20. The outsert of claim 12, wherein the tapered bore includes a plurality of cylindrical steps with a first forward most step having a lesser diameter than a rearwardly adjacent cylindrical step.

21. A method of attaching an outsert to an arrow shaft forward end, comprising the steps of:

providing an elongated tubular outsert having forward and rearward ends, a cylindrical rearward bore extending forwardly from the rearward end, and a tapered bore extending forwardly from a forward end of the rearward bore;

applying adhesive to an outer surface of the shaft forward end;

inserting the forward end of the shaft into the outsert rearward bore until the shaft forward end contacts the tapered bore uniformly and continually around the circumference thereof; and crimping a rearward end of the outsert into uniform and continuous contact around the circumference of the arrow.

22. The method of claim 21, wherein said crimping step includes: sliding a ferrule forwardly along said shaft and over the outer surface of the rearward end of any outsert rearward section, the ferrule having an inner surface with at least a portion having a diameter greater than the outer diameter of the outsert rearward end but less than the diameter of a forward end of a rearward section of the outsert.

23. The method of claim 21, wherein said crimping step includes:

connecting a ring portion of a tool to the shaft, rearwardly of the outsert, the ring portion having an inner surface with a diameter greater than the outer diameter of a rearward end of a rearward section of the outsert but less than the diameter of a forward end of the outsert rearward section;

sliding the tool forwardly until a portion of the outsert rearward section is crimped into uniform circumferential contact with the arrow shaft, by the ring portion;

sliding the tool rearwardly from the outsert; and removing the tool from the shaft.

24. The method of claim 21, wherein said crimping step includes sliding an inner ferrule forwardly along said shaft and between a rearward section of the outsert and the shaft, the ferrule having an outer surface with a diameter at a forward end less than the inner diameter of the rearward bore, and a diameter rearwardly of the forward end greater than the diameter of the rearward bore.

* * * * *